US005964130A

United States Patent [19]

Wang

[11] Patent Number: 5,964,130

[45] Date of Patent: Oct. 12, 1999

[54] JAW MEMBERS FOR A PAIR OF PLIERS

[76] Inventor: Chao-Chi Wang, P.O. Box 63-247, Taichung, Taiwan

[21] Appl. No.: 09/080,795

[22] Filed: May 18, 1998

[51] Int. Cl.[6] ..... B25B 7/02

[52] U.S. Cl. ..... 81/424; 81/426

[58] Field of Search ..... 81/424, 424.5, 81/426

[56] References Cited

U.S. PATENT DOCUMENTS

| | | | |
|---|---|---|---|
| 2,385,654 | 9/1945 | Seashore | 81/424 |
| 2,478,696 | 8/1949 | Isele | 81/424 |
| 2,584,353 | 2/1952 | Keiser | 81/424 X |
| 2,603,995 | 7/1952 | Sandstrom | 81/424 |
| 2,733,624 | 2/1956 | Dowidat | 81/424 |
| 3,779,108 | 12/1973 | Reiter | 81/424 |
| 3,964,352 | 6/1976 | Dukes | 81/426 |
| 4,157,594 | 6/1979 | Raabe | 81/424.5 X |
| 4,989,479 | 2/1991 | Anderson et al. | 81/424.5 |
| 5,630,345 | 5/1997 | Ciccotelli | 81/424 X |

*Primary Examiner*—James G. Smith
*Attorney, Agent, or Firm*—Charles E. Baxley, Esq.

[57] ABSTRACT

Jaw members for a pair of pliers includes a first jaw member connected to the first handle and a second jaw member connected to a second handle which is pivotally connected to the first handle. An inner side of the first jaw member includes a first and a second function surface, wherein the second function surface extends inclinedly corresponding to a longitudinal axis of the first handle and toward the second jaw member. A function member is pivotally mounted to an inner side of the second jaw member with a spring biasedly connected therebetween.

5 Claims, 8 Drawing Sheets

JAW MEMBERS FOR A PAIR OF PLIERS

BACKGROUND OF THE INVENTION

1. Field of the Invention

The present invention relates to two jaw members for a pair of pliers, and more particularly, to the two jaw members of a pair of locking pliers. A first jaw member of the pair of locking pliers has a first function surface and a second function surface which extends inclinedly toward a second jaw member which has a function member pivotally disposed thereto.

2. Brief Description of the Prior Art

FIG. 8 shows a pair of conventional locking pliers which generally includes a first handle 110, a second handle 14, a lever 13 adjustably connected between the two handles 110, 14, a first jaw member 11 connected to a front end of the first handle 110, a second jaw member 22 having two pivoting positions respectively and pivotally connected to the first handle 110 and the second handle 14, a spring 131 biasedly connected between the first handle 110 and the second handle 14, a release lever 141 pivotally connected to a mediate portion of the second handle 14 so as to contact against the lever 13, and an adjusting screw 12 threadedly connected to a rear end of the first handle 110. The first jaw member 11 and the second jaw member 22 each have a function surface 1110/221 defined in an inner side thereof, such as a toothed surface so as to clamp an object therebetween. Basically, there are two types of jaw members, one of which has a curved function surface so as to clamp a tubular object between two curved function surfaces, and the other type has a substantially straight function surface as shown in FIG. 8 so as to clamp a rectangular or hexagonal object between the two straight function surfaces. Accordingly, a user has to prepare the two types of pliers so that he/she can deal with objects having different shapes. This is extremely troublesome if a user carries so many tools and works in a narrow space. If the straight function surfaces are used to clamp a tubular object, only two contacting points between the jaw members and the object can be utilized, the tubular object could slip from the two jaw members because the two jaw members are opened wide. If the curved function surfaces are used to clamp a rectangular object, only four contacting points between the jaw members and the object can be utilized. Furthermore, such locking pliers are so heavy and not suitable to change frequently.

The present invention provides an improved structure of the jaw members of a pair of pliers so as to mitigate the problems as mentioned above.

SUMMARY OF THE INVENTION

In one aspect of the present invention, there is provided two jaw members for a pair of pliers which comprises a first handle and a second handle pivotally interconnected to the first handle. A first jaw member is disposed to a front end of the first handle and a second jaw member is disposed to the second handle.

The first jaw member has an inner side including a first function surface and a second function surface which is located opposite to the first handle and extends inclinedly corresponding to a longitudinal axis of the first handle and toward the second jaw member. The first function surface extends in parallel with the longitudinal axis of the first handle.

The second jaw member has a function member pivotally mounted to an inner side thereof with a resilient member biasedly connected between the second jaw member and the function member.

It is an object of the present invention to provide a pair of locking pliers which are suitable to securely clamp a tubular object and a polygonal object without changing different pliers.

It is another object of the present invention to provide a pair of locking pliers which provide large contacting areas between the two jaw members and the object to be clamped.

How these and other objects are accomplished will become apparent from the following descriptions and from the drawings.

DETAILED DESCRIPTION OF THE PREFERRED EMBODIMENT

Figure 1:
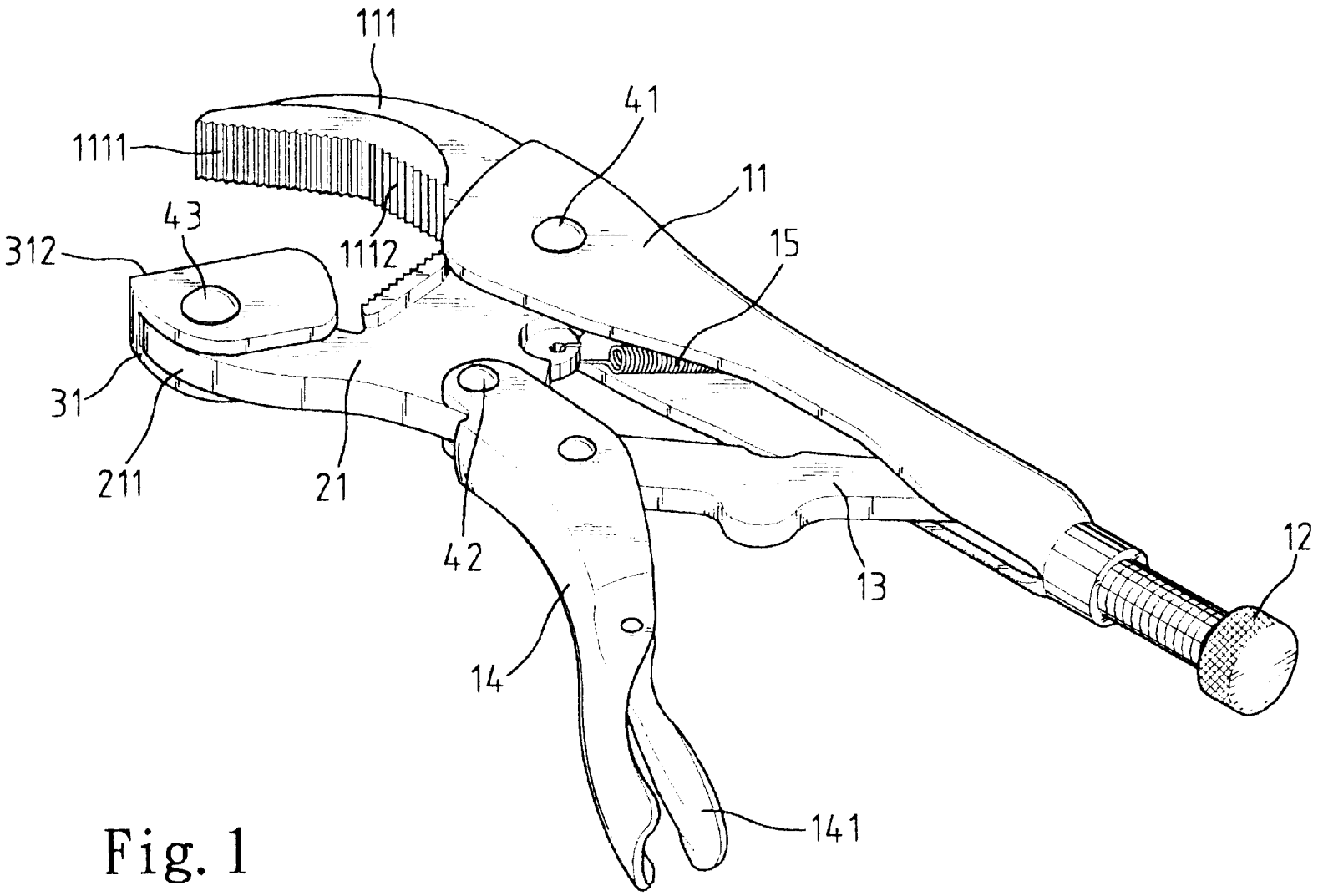
FIG. 1 is a perspective view of a pair of locking pliers having two jaw members in accordance with the present invention.
Figure 2:
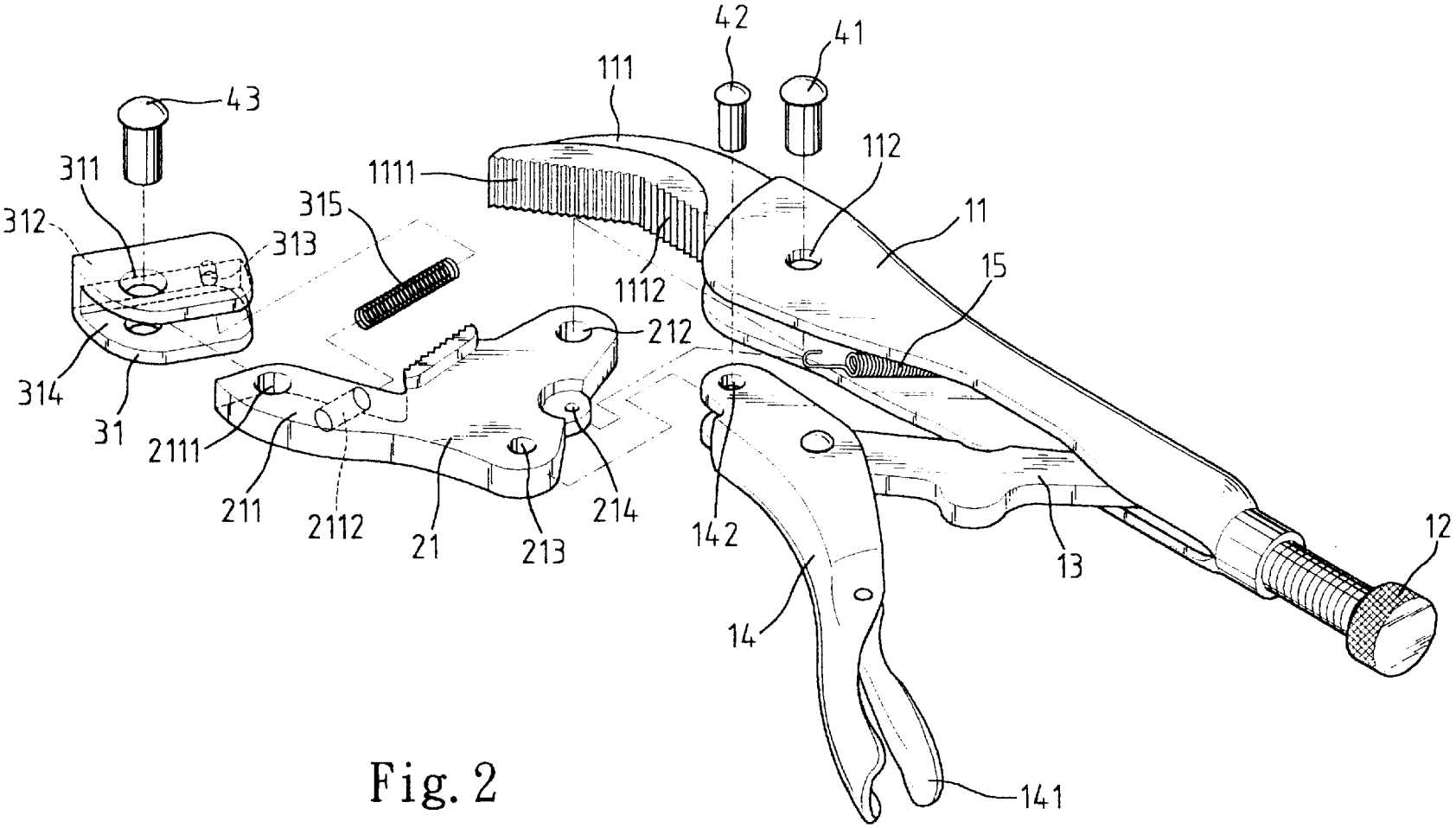
FIG. 2 is an exploded view of the two jaw members in accordance with the present invention.
Figure 3:
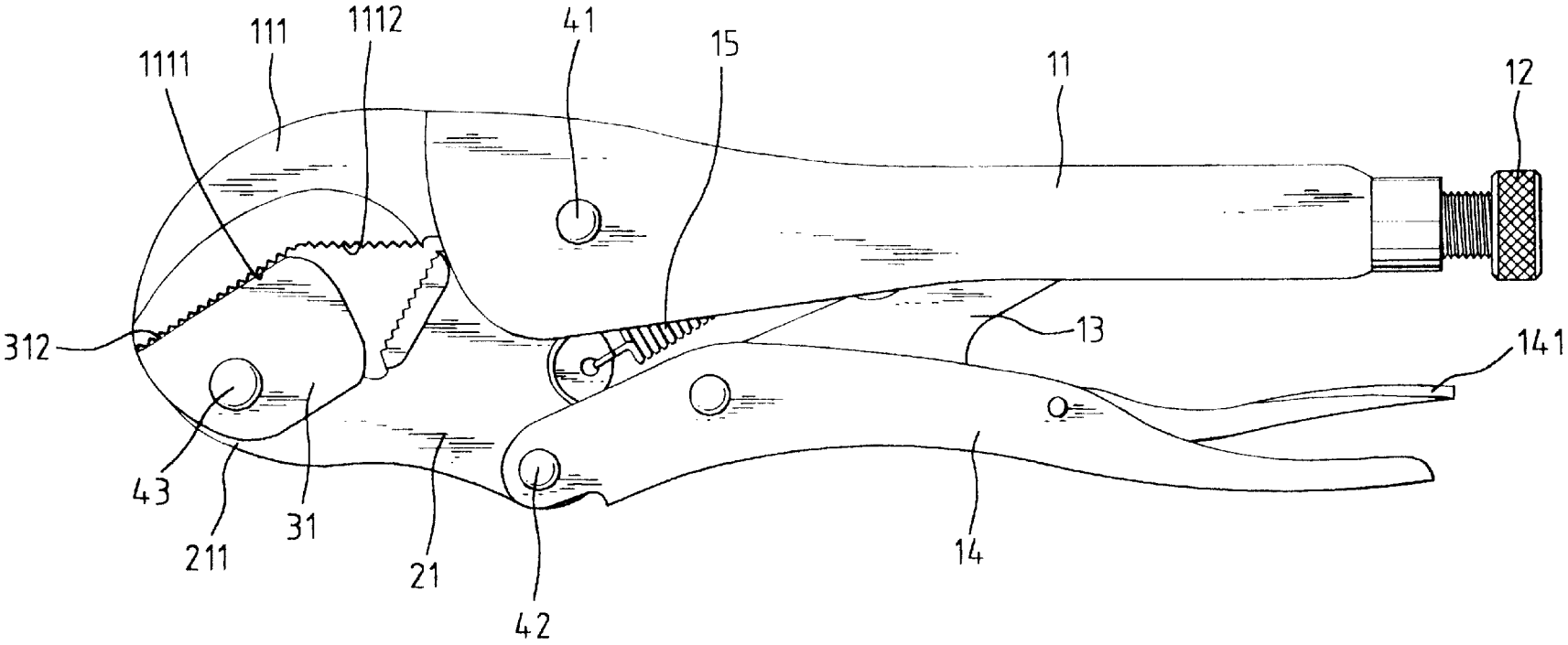
FIG. 3 is a side elevational view of the pliers when a function member contacts the first jaw member of the present invention.

Referring to the drawings and initially to FIGS. 1 through 4, a pair of locking pliers in accordance with the present invention generally includes a first handle 11 and a second handle 14 with a lever 13 connected therebetween. An adjusting screw 12 is threadedly connected to a rear end of the first handle 11 so as to movably push an end of the lever 13. The second handle 14 has a release lever 141 pivotally connected to a mediate portion thereof. A first jaw member 111 is disposed to a front end of the first handle 11 and an inner side of the first jaw member 111 includes a first function surface 1112 and a second function surface 1111 which is located opposite to the first handle 11 and extends inclinedly corresponding to a longitudinal axis of the first handle 11 and toward a second jaw member 211 which is disposed to the second handle 14. The first function surface 1112 extends in parallel with the longitudinal axis of the first handle 11. Each of the first function 1112 and the second function surface 1111 are a toothed surface.

The second jaw member 211 has a base portion 21 extending laterally therefrom which has a first hole 212, a second hole 214 and a third hole 213 respectively defined therethrough. The base portion 21 is pivotally connected to the first handle 11 by extending a first pin 41 through a hole defined through the first handle 11 and the first hole 212. The second handle 14 is pivotally connected to the base portion 21 by extending a second pin 42 through a hole defined through the second handle 14 and the third hole 213. A resilient member 15, such as a spring, has one end thereof fixedly connected to the first handle 11 and the other end thereof hooked to the second hole 214 of the base portion 21.

Figure 4:
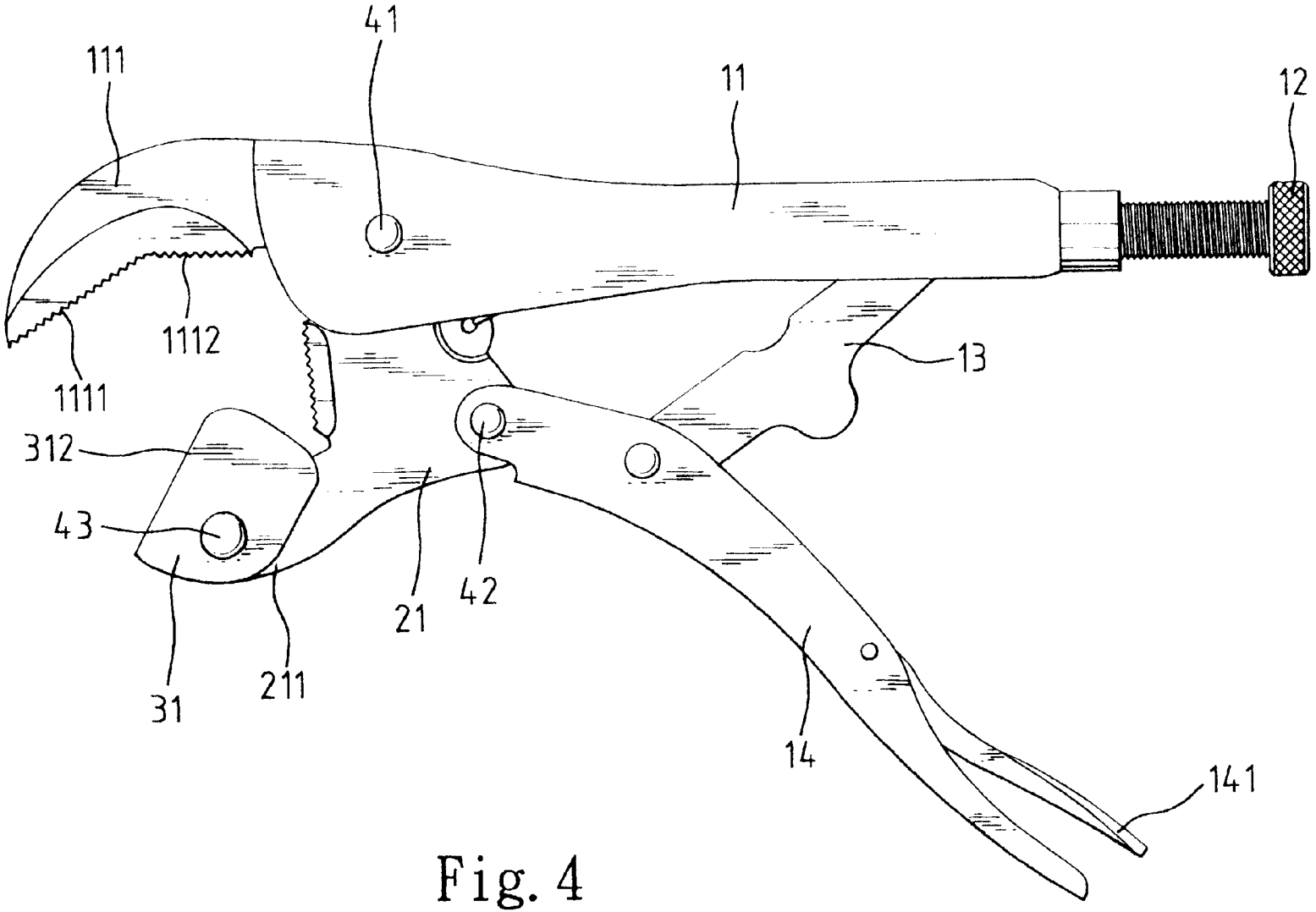
FIG. 4 is a side elevational view of the pliers when the function member is separated from the first jaw member of the present invention.

A function member 31 has a slot 314 defined in a first side thereof and the slot 314 is defined by a bottom and two side walls each of which has an aperture 311 defined therethrough. The function member 31 is pivotally mounted to an inner side of the second jaw member 211 by extending a pivot 43 extending through the two apertures 311 and a hole 2111 defined through a distal end of the second jaw member 211 so that the inner side of the second jaw member 211 is received in the slot 314. The second jaw member 211 has a first recess 2112 defined in the inner side thereof and the function member 31 has a second recess 313 defined in the bottom defining the slot 314 thereof so that a resilient member 315 is received between the first recess 2112 and the second recess 313 to urge a lower end of the function member 31 away from the inner side of the second jaw member 211 as shown in FIG. 4. The function member 31 has a flat surface 312 defined in a second side thereof opposite to the first side and the second side faces to the first jaw member 111.

Figure 6:
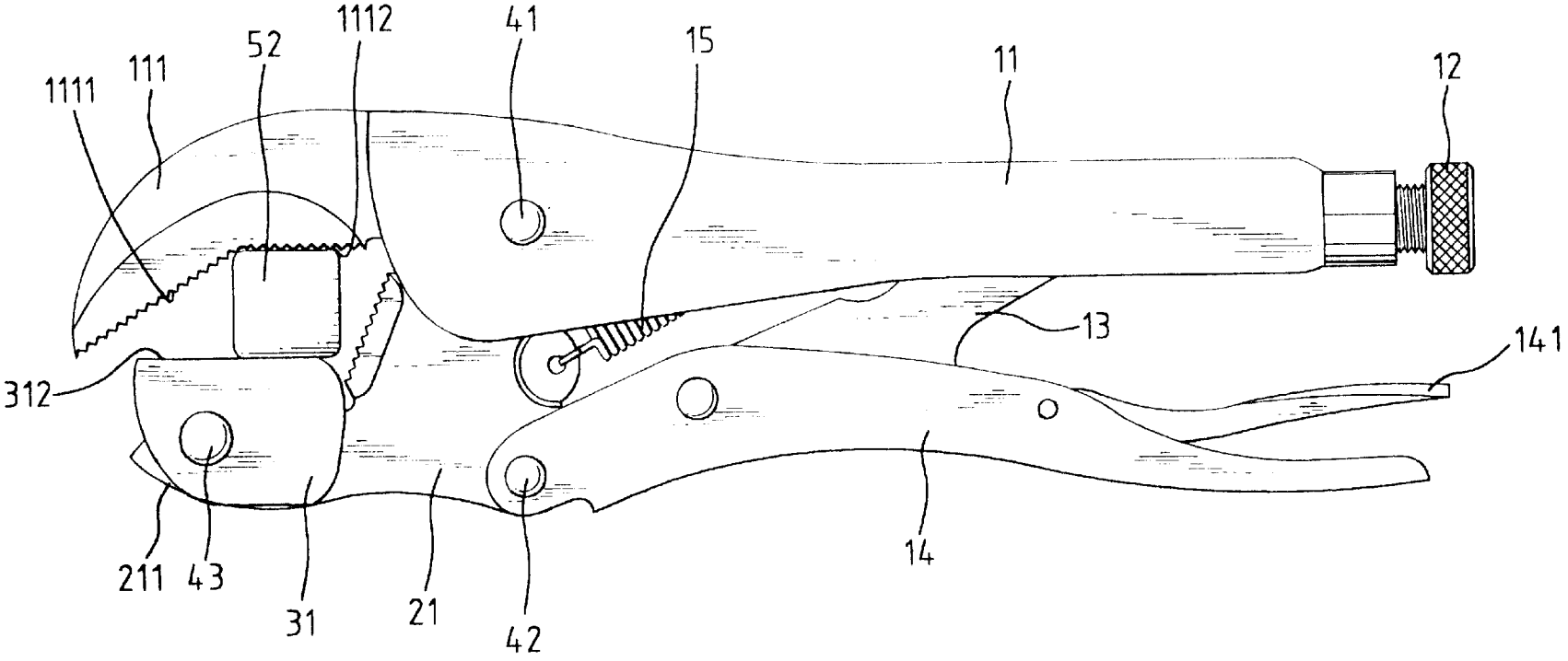
FIG. 6 is an illustrative view so show when a rectangular object is clamped between the function member and the first jaw member.
Figure 7:
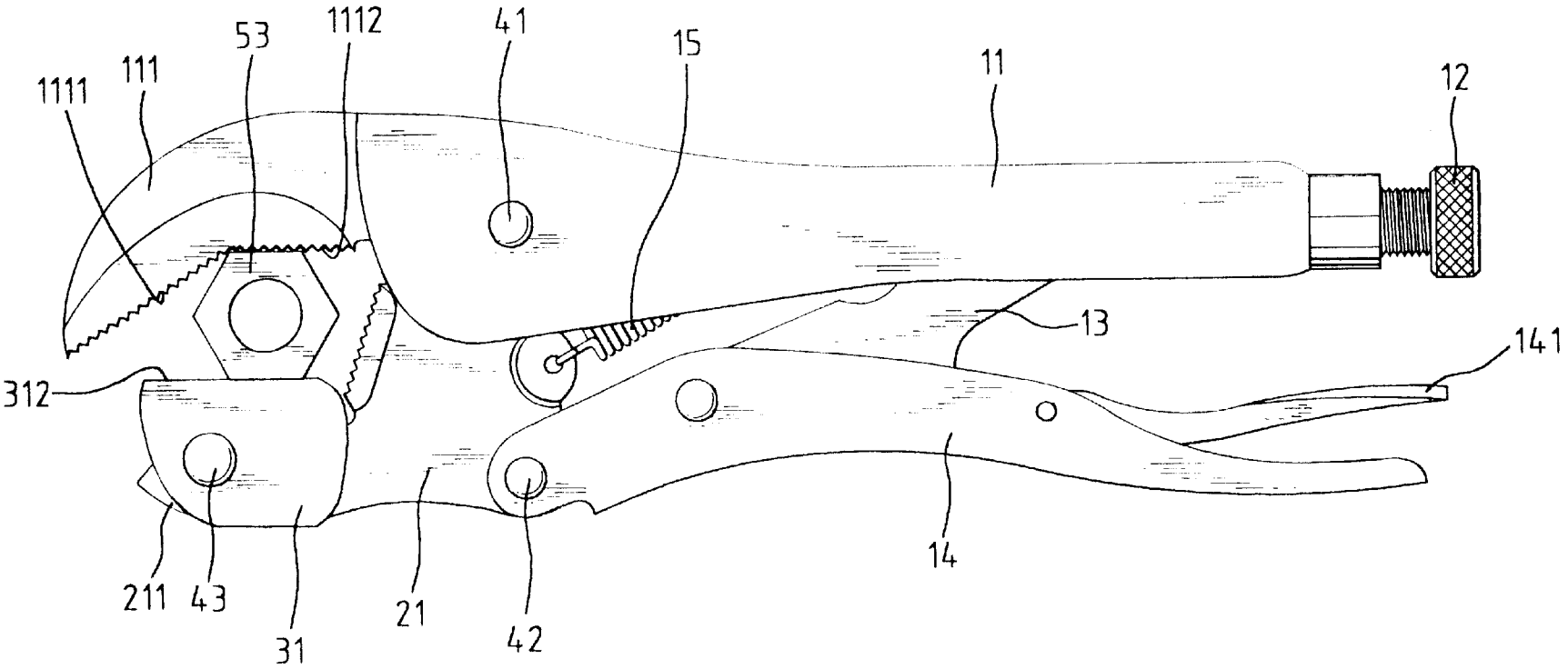
FIG. 7 is an illustrative view so show when a hexagonal object is clamped between the function member and the first jaw member.
Figure 8:
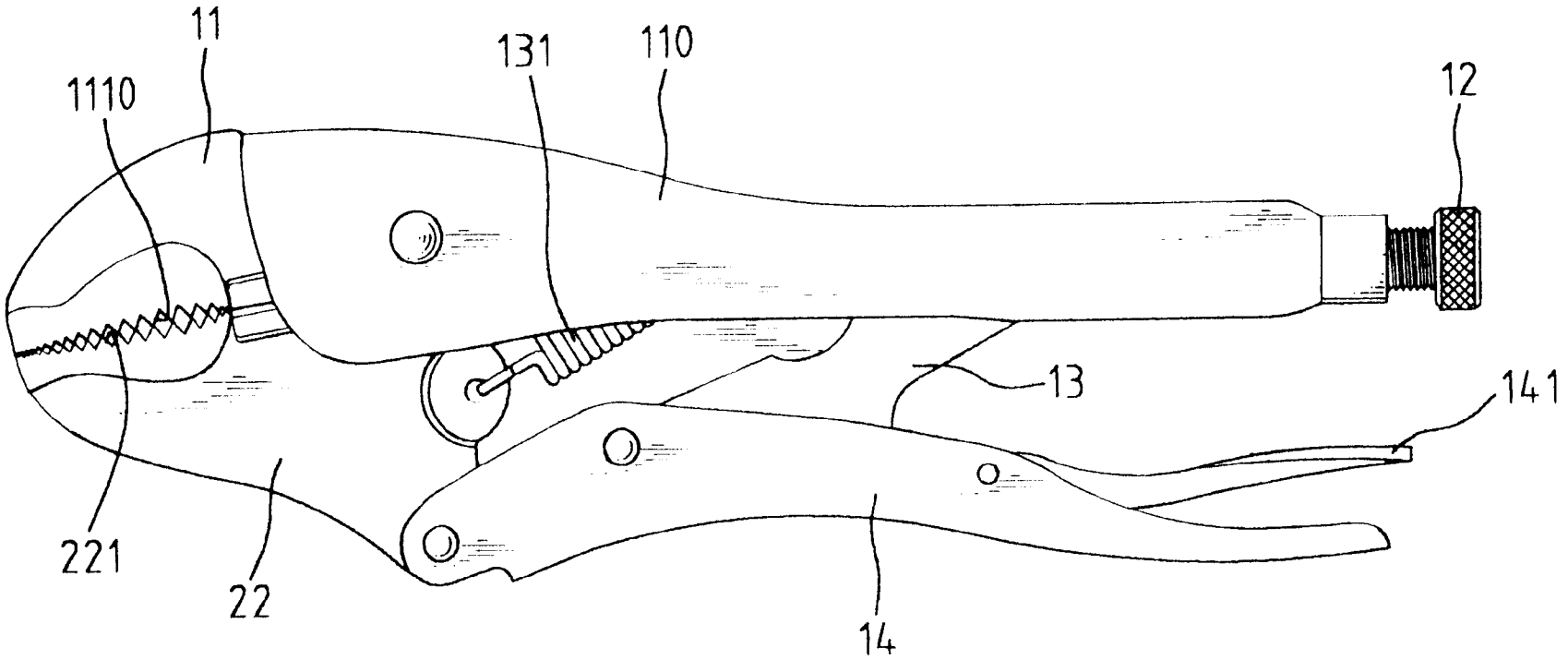
Fig. 8 PRIOR ART
FIG. 8 is a side elevational view of a pair of conventional locking pliers.

The inner side of the second jaw member 211 is parallel to the first function surface 1112 of the first jaw member 111 so that when the inner side of the second jaw member 211 contacts the bottom defining the slot 314 of the function member 31, the flat surface 312 of the second side of the function member 31 is parallel to the first function surface 1112 as shown in FIGS. 6 and 7.

Figure 5:
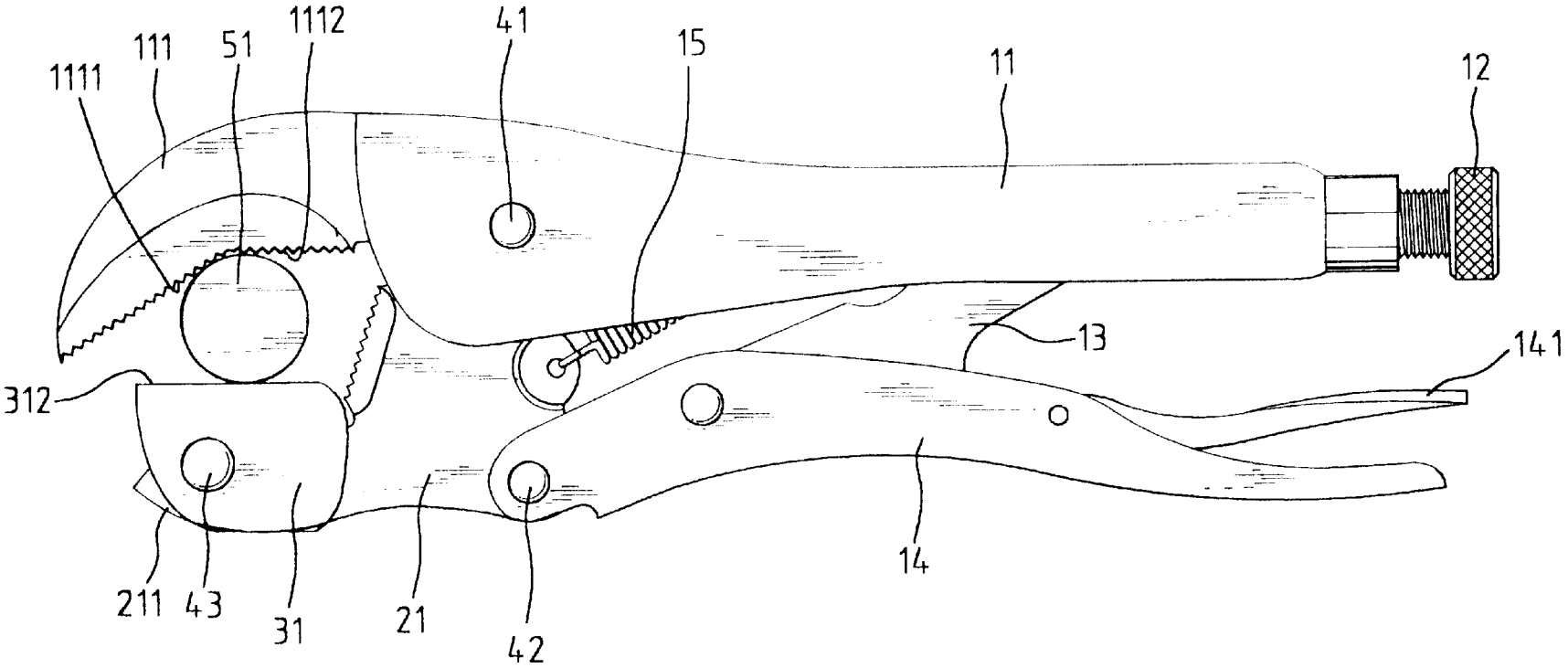
FIG. 5 is an illustrative view so show when a tubular object is clamped between the function member and the first jaw member.

Referring to FIG. 5, when clamping a tubular object 51 between the first jaw member 111 and the second jaw member 211, the object 51 will be located to contact both the first function surface 1112 and the second function surface 1111, and the function member 31 is pushed by the object 51 to let the bottom defining the slot 314 thereof contacting the inner side of the second jaw member 211 so that the object 51 is securely clamped between the first function surface 1112, the second function surface 1111 and the flat surface 312 of the function member 31. It is to be noted that a gap between the second function surface 1111 and the flat surface 312 of the function member 31 is convergent so as to effectively prevent the object from slipping between the two jaw members 111, 211.

Referring to FIGS. 6 and 7, when clamping a rectangular object 52 between the first jaw member 111 and the second jaw member 211, two opposite sides of the four sides of the object 52 are clamped by the first function surface 1112 of the first jaw member 111 and the flat surface 312 of the function member 31. Similarly, the gap between the second function surface 1111 and the flat surface 312 of the function member 31 is convergent.

When clamping a hexagonal object 53 between the first jaw member 111 and the second jaw member 211, two opposite sides of the six sides of the object 53 are clamped by the first function surface 1112 of the first jaw member 111 and the flat surface 312 of the function member 31. Also, the gap between the second function surface 1111 and the flat surface 312 of the function member 31 is convergent.

The locking pliers having the two jaw members 111, 211 and the function member 31 has a novelty structure and can clamp either the tubular object 51 or the polygonal objects 52, 53 without changing different pliers. The object clamped by the first jaw member 111 and the function member 31 is will positioned because of the gap between the second function surface 1111 and the function member 13 is convergent so that the problems happened to the conventional locking pliers are resolved. The present invention can be utilized to other types of pliers and will provides the same function.

While particular embodiments of the present invention have been illustrated and described herein, it is not intended to limit the invention and changes and modifications may be made therein within the scope of the invention as hereinafter claimed.

What is claimed is:

1. A pair of pliers comprising:

a first handle and a second handle which is pivotally interconnected to said first handle, a first jaw member connected to a front end of said first handle and a second jaw member connected to said second handle;

said first jaw member having an inner side including a first function surface and a second function surface, said second function surface located in opposite to said first handle and extending inclinedly corresponding to a longitudinal axis of said first handle and toward said second jaw member;

said second jaw member having a function member pivotally mounted to an inner side thereof, said function member having a slot defined in a first side thereof so that said inner side of said second jaw member is received in said slot, a first recess defined in said inner side of said second jaw member and said function member having a second recess defined in a bottom defining said slot of said function member, said inner side of said second jaw member being parallel to said first function surface of said first jaw member, said function member having a second side located opposite to said first side of said function member and parallel to said first function surface, and a resilient member received between said first recess of said second jaw member and said second recess of said function member.

2. The pliers as claimed in claim 1 wherein said function member has two side walls separated by said slot and each of said side walls has an aperture defined therethrough so that a pivot extends through said two apertures and a distal end of said second jaw member.

3. The pliers as claimed in claim 1 wherein said function member has a flat surface defined in a second side thereof opposite to said first side of said function member and said second side faces said first jaw member.

4. The pliers as claimed in claim 1 wherein each of said first function surface and said second function surface is a toothed surface.

5. The pliers as claimed in claim 1 wherein said first function surface extends in parallel with said longitudinal axis of said first handle.

* * * * *